US007106041B1

(12) United States Patent
Cohen

(10) Patent No.: US 7,106,041 B1
(45) Date of Patent: Sep. 12, 2006

(54) CURRENT MIRROR APPARATUS AND METHOD FOR REDUCED EARLY EFFECT

(75) Inventor: Stephen A. Cohen, Andover, MA (US)

(73) Assignee: Analog Devices, Inc., Norwood, MA (US)

( * ) Notice: Subject to any disclaimer, the term of this patent is extended or adjusted under 35 U.S.C. 154(b) by 124 days.

(21) Appl. No.: 10/868,580

(22) Filed: Jun. 14, 2004

(51) Int. Cl.
*G05F 3/16* (2006.01)

(52) U.S. Cl. ..... 323/315

(58) Field of Classification Search ..... 323/313, 323/314, 315, 316
See application file for complete search history.

(56) References Cited

U.S. PATENT DOCUMENTS 4,769,589 A * 9/1988 Rosenthal ..... 323/313
5,600,235 A * 2/1997 Thomas ..... 323/315
5,668,467 A * 9/1997 Pease ..... 323/315
5,910,748 A * 6/1999 Reffay et al. ..... 327/432
6,194,886 B1 2/2001 D'Aquino et al. ..... 323/315

OTHER PUBLICATIONS

Paul Horowitz and Winfield Hill, *Ebers-Moll Applied to Basic Transistor Circuits*, The Art of Electronics, Second Edition Cambridge University Press 1989, p. 89.
Data Sheet, *High Speed, Low Power Monolithic OP AMP AD847*, Analog Devices, Rev. F, C1191f-10-9/92, p. 9.

* cited by examiner

*Primary Examiner*—Adolf Berhane
(74) *Attorney, Agent, or Firm*—Koppel, Patrick & Heybl

(57) ABSTRACT

A current mirror includes an output stage that responds to a change in mirror output voltage with a change in output stage current, and an output compensation stage that, in response to the change in output stage current, introduces an output compensation current to oppose a change in mirror output current resulting from the change in output stage current.

26 Claims, 2 Drawing Sheets

CURRENT MIRROR APPARATUS AND METHOD FOR REDUCED EARLY EFFECT

BACKGROUND OF THE INVENTION

1. Field of the Invention

This invention relates to electrical circuits and, more particularly, to current mirrors.

2. Description of the Related Art

Integrated circuits often use current mirrors when it is desired to replicate a current from a first portion of a circuit to a second portion. Two typical problems with such current mirrors include Early effect, resulting in a difference between input and output currents as a result of a difference between input and output voltages, and beta error, the difference between input and output currents when no difference in input and output voltages exists.

One attempt to reduce these errors is illustrated in U.S. Pat. No. 6,194,886. In this patent, a compensation circuit has two compensation stages connected to either side of an output stage of the current mirror to, in response to a change in output voltage, provide a change of current to the output of the output stage to reduce Early effect and beta error. Unfortunately, the compensation circuit requires the addition of three transistors to provide the response to the current mirror.

A need still exists for reducing Early effect and base current errors in current mirrors without adding unnecessary components.

SUMMARY OF THE INVENTION

A current mirror includes, in one embodiment of the invention, an output stage and an output compensation stage. The output stage responds to a change in mirror output voltage with a change in output stage current. The output compensation stage, in response to the change in output stage current, introduces an output compensation current to oppose a change in mirror output current.

A method of reducing Early effect current in a current mirror includes supplying an input current and output voltage, inducing a mirrored output current in response to the input current and output voltage, inducing a change in an output stage current in response to a change in output voltage, and providing an output compensation current in response to the change in output stage current wherein said output compensation current compensates for said change in output stage current.

BRIEF DESCRIPTION OF THE DRAWINGS

The components in the figures are not necessarily to scale, emphasis instead being placed on illustrating the principals of the invention. Moreover, in the figures, like reference numerals designate corresponding parts throughout the difference views.

DETAILED DESCRIPTION OF THE INVENTION

Figure 1:
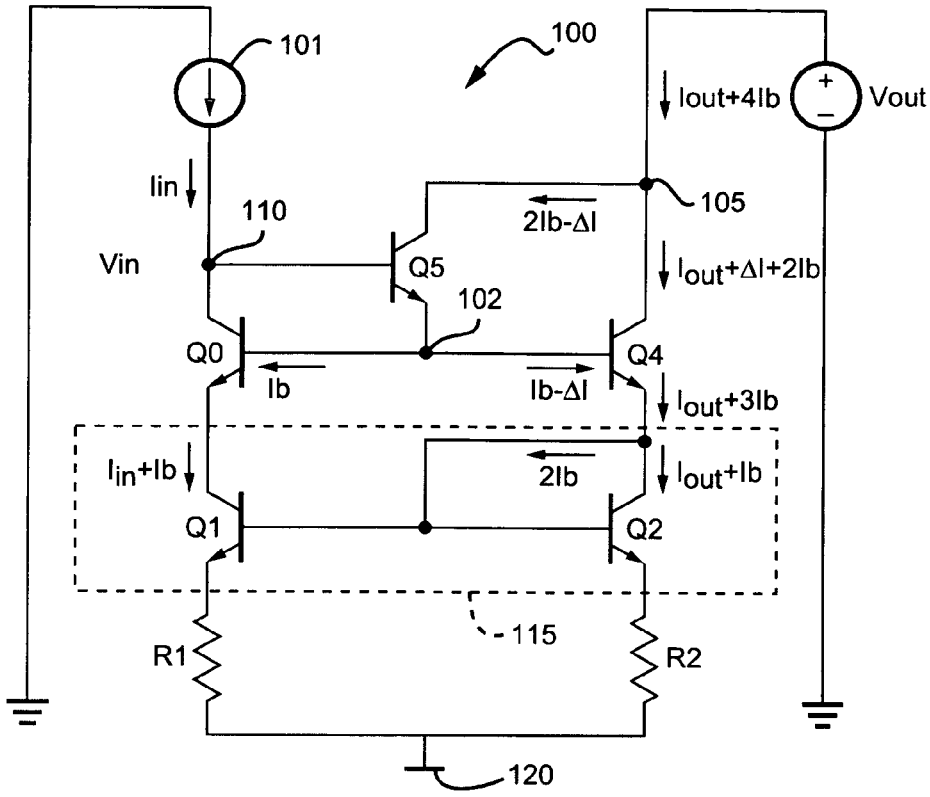
FIG. 1 is a schematic diagram of one embodiment of the invention for a current mirror that has a compensation stage.

FIG. 1 illustrates a current mirror 100, in accordance with one embodiment of the invention, which includes first input and output stages and an output compensation stage. The output compensation stage provides a change in compensation current that opposes a change in the first output stage current, thus reducing differences between the mirror's input and output currents without the addition of undesirable circuit complexity.

The first input stage, preferably implemented as a first input transistor Q0, is connected at its collector to a current source 101, to receive an input current Iin. Current source 101 is included for convenience. Similar to other current mirrors, the current source 101 can be either a fixed or variable power source, including a resistor to a power supply. The first output stage, preferably a first output transistor Q4, is connected at its base to the base of the first input transistor Q0 so that the first output and input transistors Q4 and Q0 share a common control terminal 102. The collector of the first output transistor Q4 is connected to an output voltage source Vout through output node 105. An output compensation stage, preferably an output compensation transistor Q5, also has its collector connected to Vout, and to the collector of first output transistor Q4 through output node 105, so that the collectors of transistors Q4 and Q5 both receive a portion of the output current Iout flowing from Vout.

The base of the output compensation transistor Q5 is connected to the collector of transistor Q0 at an input node 110 so that they each receive an input voltage Vin as a result of Iin. The emitter of the output compensation transistor Q5 is connected to provide base current to both transistors Q0 and Q4. The emitters of transistors Q0 and Q4 are connected to second input and second output stages Q1 and Q2, respectively, which collectively form a second-stage current mirror 115. Preferably, second input and output stages Q1 and Q2 are transistors, with transistor Q2 diode connected, and their collectors connected to the emitters of transistors Q0 and Q4, respectively. Or, Q2 can be a current source to drive the emitter of Q4. The emitters of Q1 and Q2 are connected, preferably through respective emitter degeneration resistors R1 and R2, to a common terminal 120.

For a current mirror 100 designed with matched transistors and equal input and output voltages, one unit of base current ("Ib") flows into the base of each transistor Q0 and Q4. Consequently, ignoring the second order base current of Q5, 2Ib flows into the collector of transistor Q5 and the output current Iout is approximately equal to Iin+4Ib (a "4Ib error" at the output). The bases of second input and output transistors Q1 and Q2 each draw an Ib current from the emitter of Q4. Because the emitter current of Q4 is approximately equal to Iout+3Ib, the collector current of Q2 is approximately equal to Iout+Ib, since 2Ib is added prior to the Q4 emitter current reaching the collector of Q2. Transistor Q1 has a collector current of Iout+Ib.

As described above, for equal input and output voltages, Iin is mirrored by Iout into output node 105 with an error of +4Ib. An increase in voltage at output node 105, however, results in a increase collector-to-emitter voltage for Q4 and a corresponding change +ΔI in its collector current, due to the Early effect. Consequently, the collector current of Q4 is approximately equal to Iout+2Ib+ΔI, thus diverting ΔI away from the collector of compensation transistor Q5. Because transistor Q4 is driven by the collector current of transistor Q2, the emitter current of Q4 is held approximately constant at Iout+3Ib. Therefore, the base current of Q4 decreases a corresponding amount ΔI to approximately Ib-ΔI. Similar to changes in current due to the Early effect, the base-collector current relationship of Q4 is not governed by the usual transistor beta during compensation. Rather, Q4 functions essentially as a summing node, with its base current decreasing by an amount necessary to compensate for the increase in its collector current, so as to supply the constant Q4 emitter current as dictated by Q2.

Base current in first input transistor Q0 is not affected by the change in output voltage source Vout and remains approximately equal to Ib, allowing the collector current of output compensation transistor Q5 to change to approximate 2Ib−ΔI. Q5's collector thus compensates for ΔI in Q4's collector to cancel the Early effect. The base current error of 4Ib remains at the mirror output, however, that is not affected by the difference between input and output voltages (Vin, Vout) for current mirror 100.

Although transistors Q0–Q2 and Q4–Q5 are illustrated as npn bipolar transistors that have base-emitter-collector terminals, they can be implemented using pnp transistors. Q5 can also be implemented as a field-effect transistor (FET) that has gate-source-drain terminals. Collector/emitter and source/drain paths can also be referred to individually as current circuits for convenience when bipolar and FET transistors can be used interchangeably. In such a case, corresponding base/gate terminals would be control terminals that have control currents and the base current compensation stage would be described as a control compensation circuit.

Figure 2:
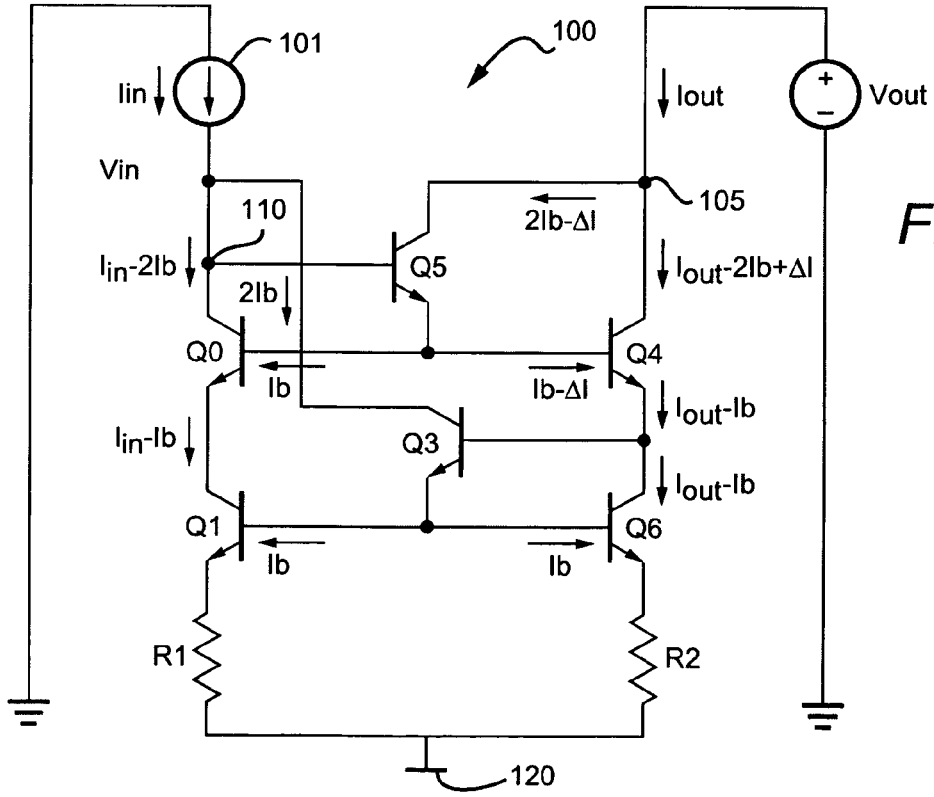
FIG. 2 is a schematic diagram of the current mirror illustrated in FIG. 1, with the addition of a base current compensation stage.

FIG. 2 is a schematic diagram of the current mirror illustrated in FIG. 1 with the addition of a base current compensation stage to eliminate the 4Ib current error in Iout conducted by output compensation transistor Q5 and output transistor Q4. The base current compensation stage replaces the diode connection of second transistor Q2 and is, preferably, a base current compensation transistor Q3 that is either a bipolar transistor or a FET. Q3's collector is connected to input node 110 to draw a 2Ib current prior to introduction of Iin to the collector of input transistor Q0. Q3's base is connected to both the collector of a non-diode-connected second output transistor Q6 and to the emitter of output transistor Q4. Q3's emitter is connected to respective bases of the first and sixth transistors Q1 and Q6 to conduct their base currents. Respective bases of first and sixth transistors Q1 and Q6 each draw an Ib current, resulting in a collector current in Q2 of 2Ib (assuming negligible base current in Q3).

As described above for FIG. 1, the output compensation transistor Q5 introduces a 2Ib base current error that increases the output current Iout prior to presentation to the output transistor Q4. With the addition of the base current compensation transistor Q3, a base current error of 2Ib is removed from the input current Iin prior to reaching the collector of Q0 resulting in both input and output stages experiencing the same 2Ib current reduction. Because output compensation transistor Q5 compensates for Early effect and base current compensation transistor Q3 corrects for base current error, both input and output currents for the current mirror are again approximately equal and corrected for Early effect.

Similar to FIG. 1, above, the current mirror 100 illustrated in FIG. 2 can be designed with either pnp or npn transistors for Q1, Q2, Q4 and Q5. Also, base current compensation transistor Q3 can be designed as a FET.

Figure 3:
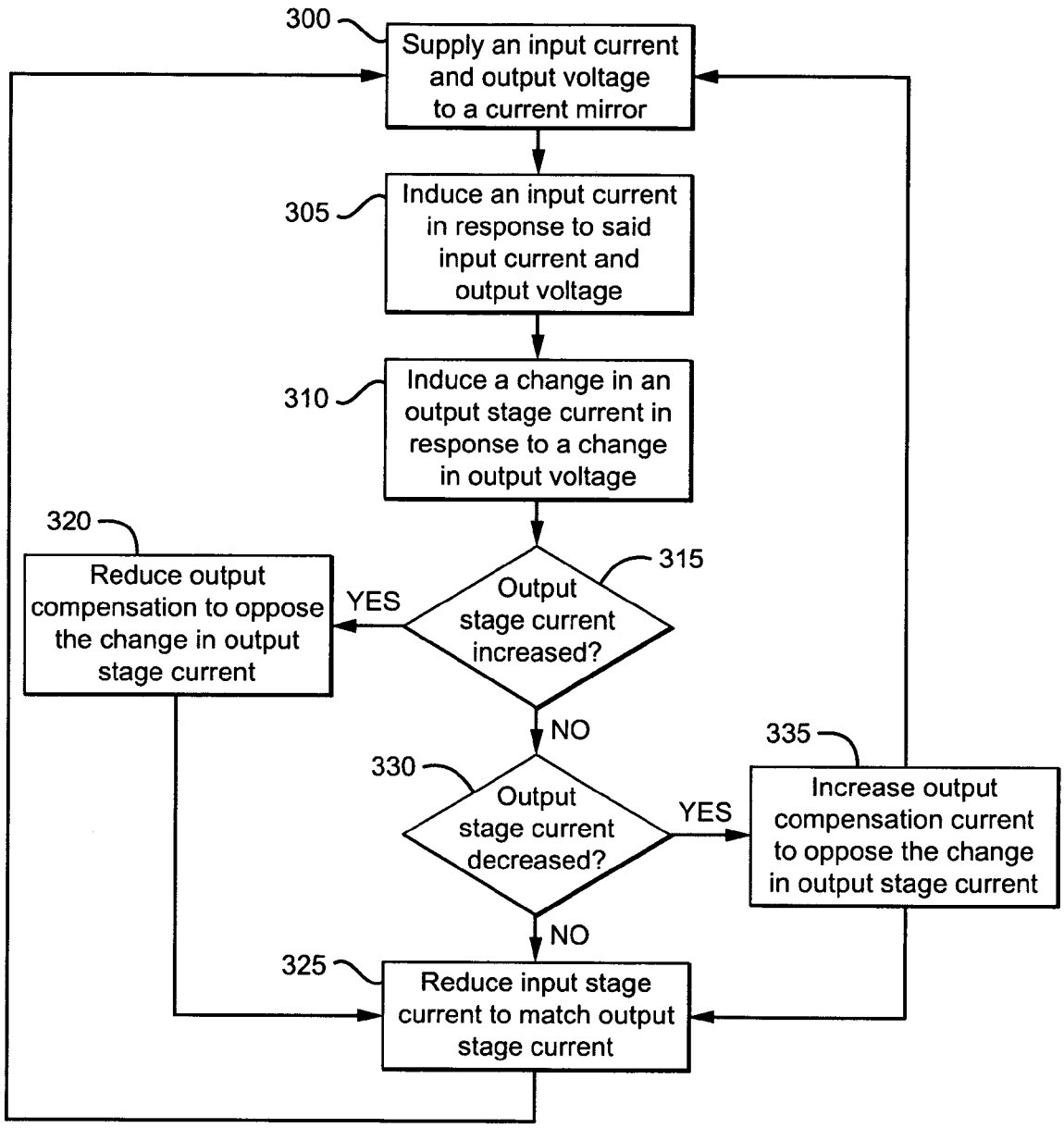
FIG. 3 is a logic flow diagram illustrating a method of reducing Early effect for the embodiment of the invention illustrated in FIG. 1.

FIG. 3 illustrates a method of providing output compensation and base compensation currents to inhibit Early effect and internal base current error in the current mirror. The input current Iin and output voltage source Vout are supplied to the current mirror (block 300) to induce the output current Iout (block 305). As a result of a ΔVout change in output voltage Vout, a ΔI change in output stage current is induced by the output stage through the output node (block 310). If the output stage current is increased (block 315), the output compensation current is reduced to oppose the change in output stage current (block 320). Preferably, the output compensation current is reduced by an amount equal to the change in output stage current so that the net change of output current as a result of the change of output voltage is approximately zero. A base compensation current reduces the input current prior to the input stage by an amount equal to the internal base current errors experience by the output stage so that input and output stage currents are approximately equal (blocks 325). If the output stage current is reduced as a result of the change in output voltage (block 330), the output compensation current provided to the output node is increased to oppose the change in output stage current (block 335). Preferably, the output compensation current is increased by an amount equal to the change in output stage current so that the net change of output current is approximately zero. The base compensation current also reduces the input current prior to the input stage by an amount equal to the internal base current errors experienced by the output stage so that input and output stage currents are approximately equal (blocks 325). Because the output compensation current compensates for Early effect and base compensation current corrects for base current error, both input and output currents for the current mirror are again approximately equal and corrected for Early effect.

While various embodiments and implementations of the invention have been described, it will be apparent to those of ordinary skill in the art that many more embodiments and implementation are possible that are within the scope of this invention.

What is claimed is:

1. A current mirror, comprising:

an output stage that responds to a change in mirror output voltage with a change in output stage current;

an output compensation stage that, in response to said change in output stage current, introduces an output compensation current to oppose a change in mirror output current; and an input stage connected to said output stage and output compensation stage to conduct a base current.

2. The current mirror of claim 1, wherein said output compensation stage comprises:

a current circuit connected to introduce said output compensation current between said output stage and a current mirror output.

3. The current mirror of claim 1, further comprising:

a second output stage connected to said output stage, said output stage having an output current that is maintained by said second output stage as the mirror output voltage changes.

4. The current mirror of claim 1, further comprising:

a single-stage current mirror coupled between said input and output stages.

5. The current mirror of claim 1, further comprising:

a base current compensation stage coupled between said output stage and said current mirror to conduct a base correction current for summation with a current mirror input current.

6. The current mirror of claim 1, wherein said input stage comprises:

a transistor having a collector terminal coupled to a current mirror input to enable a collector current.

7. The current mirror of claim 1, wherein said output stage further comprises:

a transistor having a collector coupled to said current mirror output to enable a collector current.

8. The current mirror of claim 1, wherein said base current compensation stage further comprises:

a transistor having a current circuit connected to a current mirror input to conduct a base compensation current.

9. A current mirror, comprising:

a current source;

an input stage coupled to receive current from said current source;

an output stage coupled on its input to an output node, said output stage operable to increase or reduce an output current draw from said output node in response to an increase or decrease in output voltage at said output node, respectively; and an output compensation stage coupled to said output and input stages and to said output node, said output compensation stage operable to reduce or increase an output compensation current drawn from said output node in response to an increase or reduction, respectively, of said output current drawn by said output stage;

wherein said output compensation stage compensates for changes in output current drawn from said output stage.

10. The current mirror of claim 9, further comprising:

a base output compensation stage coupled to said input and output stages, said base output compensation stage operable to conduct a base current from said current source.

11. The current mirror of claim 9, wherein said input stage comprises:

a transistor having a collector coupled to said current source.

12. The current mirror of claim 11, wherein said transistor is diode connected.

13. The current mirror of claim 9, wherein said output stage comprises:

a transistor having a collector coupled to said output node and a base coupled to said output compensation stage.

14. The current mirror of claim 9, wherein said output compensation stage comprises:

a transistor having a collector coupled to said output node.

15. The current mirror of claim 14, wherein said output compensation stage further comprises an emitter coupled to said output stage.

16. The current mirror of claim 15, wherein said output compensation stage further comprises a base coupled to said output stage.

17. The current mirror of claim 15, wherein said output stage further comprises a transistor.

18. A current mirror, comprising:

input and output transistors, each having a shared base; and an output compensation transistor having a current circuit coupled to said shared bases;

wherein, in response to said output transistor changing its collector current, a current of said current circuit is changed by an amount at least equal and opposite to said change of collector current of said output transistor.

19. The current mirror of claim 18, further comprising:

a second input transistor providing a current source for said input transistor.

20. The current mirror of claim 19, further comprising:

a second output transistor providing a current source for said output transistor.

21. The current mirror of claim 20, further comprising:

a base output compensation transistor, said output compensation transistor having a second current circuit coupled between said input transistor's collector and said second output transistor's base.

22. The current mirror of claim 20, further comprising:

first and second degeneration resistors coupled to said second input and second output transistors, respectively.

23. The current mirror of claim 18, further comprising:

a current source coupled to a collector of said input transistor.

24. A method of reducing Early effect current in a current mirror, comprising:

supplying an input current and output voltage;

inducing a mirrored output current in response to said input current and output voltage;

inducing a change in an output stage current in response to a change in output voltage;

providing an output compensation current in response to said change in output stage current, said output compensation current opposing said change in output stage current; and reducing said input current by a base output compensation current to reduce a difference in output and input mirror currents;

wherein said output compensation current compensates for said change in output stage current.

25. A current mirror, comprising:

an output transistor having first and control currents that change by equal and opposite amounts in response to a change in an output voltage of said current mirror;

an output compensation circuit that, in response to a change in said control current, communicates said change in control current to an output current of said current mirror;

an input transistor to coupled to an input voltage for said current mirror; and a control compensation circuit to communicate two transistor-control currents to said input transistor;

wherein said output current remains constant in response to said change in said output voltage.

26. The current mirror of claim 25, further comprising:

a current source coupled to said output transistor to drive it with a constant current.

* * * * *